United States Patent [19]

Kassai

[11] Patent Number: 4,571,760

[45] Date of Patent: Feb. 25, 1986

[54] CARRY-COT

[75] Inventor: Kenzou Kassai, Osaka, Japan

[73] Assignee: Kassai Kabushikikaisha, Osaka, Japan

[21] Appl. No.: 603,441

[22] Filed: Apr. 24, 1984

[30] Foreign Application Priority Data

May 13, 1983 [JP] Japan ..... 58-72003[U]

[51] Int. Cl.[4] ..... A47C 29/00

[52] U.S. Cl. ..... 5/99 R; 5/99 A; 5/98 R

[58] Field of Search ..... 5/94, 98 R, 98 A, 98 B, 5/98 C, 99 A, 99 C; 292/263

[56] References Cited

U.S. PATENT DOCUMENTS

| | | | |
|---|---|---|---|
| 1,552,988 | 9/1925 | Hoberg et al. | 292/263 |
| 1,706,762 | 3/1929 | Wihebrink | 5/98 B |
| 2,846,699 | 8/1958 | Watson | 5/98 R |
| 3,096,917 | 7/1963 | Gudiksen | 5/98 R |
| 4,010,880 | 3/1977 | Guillot-Munoz | 5/94 |
| 4,436,330 | 3/1984 | Mayo et al. | 292/263 |

FOREIGN PATENT DOCUMENTS

| | | | |
|---|---|---|---|
| 65660 | 4/1982 | Japan . | |
| 682102 | 11/1952 | United Kingdom | 5/99 A |
| 699499 | 11/1953 | United Kingdom | 5/98 R |

*Primary Examiner*—Kenneth J. Dorner
*Assistant Examiner*—Michael F. Trettel
*Attorney, Agent, or Firm*—W. G. Fasse; D. H. Kane, Jr.

[57] ABSTRACT

A carry-cot is collapsible from an open use state into a flat state. For this purpose the cot has an upper frame and a lower frame, with a flexible sheet stretched between these two frames to form an all-around side wall. A bottom plate is placed on the lower frame. The upper and lower frames are connected by four foldable links. As these links are collapsed or folded, the upper frame approaches the lower frame until the flat collapsed state is established. A first belt is attached at its ends to the first and second link and a second belt is attached at its ends to the third and fourth link means for carrying the cot.

9 Claims, 12 Drawing Figures

CARRY-COT

BACKGROUND OF THE INVENTION

This invention relates to a carry-cot and particularly to a box-type carry-cot which is collapsible when not in use.

A carry-cot is a portable bed used to carry a baby lying therein from place to place. A conventional carry-cot, as disclosed, e.g., in Japanese Utility Model Application Disclosure No. 65660/1982, generally comprises an upwardly open shell having its bottom and lateral surfaces laid with a pad of elastic material such as resin. Besides this, there are many other carry-cot constructions, but so far as I know, there has been no carry-cot of easily collapsible construction.

SUMMARY OF THE INVENTION

Accordingly, an object of this invention is to provide a carry-cot which is collapsible but nevertheless has sufficient strength in its use state.

More particularly, the invention provides a carry-cot having a fixed form in its use state with sufficient strength to provide safety for carrying a baby and which assumes a flat state when collapsed to provide convenience for transport and storage.

This invention is box-type carry-cot in the form of an upwardly open box frame with flexible belts connected at their opposite ends to the box frame at frame points positioned around the center of gravity of the carry-cot, so that the carry-cot can be suspended by lifting the belts, said carry-cot being characterized in that it comprises:

an upper frame forming a peripheral end edge surrounding an upper opening of the cot, a lower base disposed parallel to and below said upper frame and defining a bottom wall of the box-type carry cot, a flexible sheet material stretched between said upper frame and said bottom wall for forming a lateral wall entirely around the box, first, second, third and fourth link means for holding said upper frame and said lower base together so as to allow movement toward and away from each other, each link means including a combination of a main support rod and an auxiliary support rod rotatably connected at its lower end to an intermediate portion of said main support rod so that both rods overlap each other, said first and second link means and said third and fourth link means being disposed adjacent each other, respectively, the lower ends of said individual main support rods being journalled to the outer periphery of said lower base at four points surrounding the center of gravity of the carry-cot, the upper ends of said individual auxiliary support rods being journalled to the outer peripheral edge of said upper frame so that when said individual link means are respectively in the linear state, the first and second link means on the one hand, and the third and fourth link means on the other hand are directed obliquely upwardly with their upper ends positioned closer to each other than their respective lower end, first folding stop means enabling said first and second link means and said third and fourth link means be folded or collapsed from their respective linear states only in one collapsing direction in which releasable connections between said main and auxiliary support rods and hence the upper ends of said rods move away form each other, second folding stop means for limiting the cot opening movement of the individual link means when they are in the linear state whereby said upper frame and said lower base are maintained at the maximum distance therebetween and substantially parallel to each other, and whereby said main support rods included in said first and second and in said third and fourth link means are prevented from further turning in the direction in which they approach each other, and lock means which for selectively maintaining the linear state of said individual link means by causing said main and auxiliary support rods to elastically engage each other.

In the use state of the present carry-cot the first and second link means and third and fourth link means respectively extend in inverted V-shaped form to prop themselves against each other, so that the distance between the upper frame and the lower base is firmly maintained. Thus, this carry-cot provides high safety when it is carried from place to place. When the carry-cot is not used, the locking actions of the lock means are canceled to collapse the individual link means, whereby the upper frame approaches the lower base for establishing the flat collapsed state. Thus, the cot is convenient for transport and storage.

In a preferred embodiment, the belts include first and second belt sections, and the opposite ends of the first belt section are attached to the main support rods included in the first and second link means, while the opposite ends of the second belt section are attached to the main support rods included in the third and fourth link means. According to this arrangement, when the carry-cot is suspended by lifting the middle portions of these belt sections, the direction of the force imparted by each end of each belt section to the associated main support rod substantially coincides with the direction in which the main support rod extends in the use state. This arrangement makes it possible to stabilize the direction of each main support rod and hence the linear state of each link means can be stably maintained.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
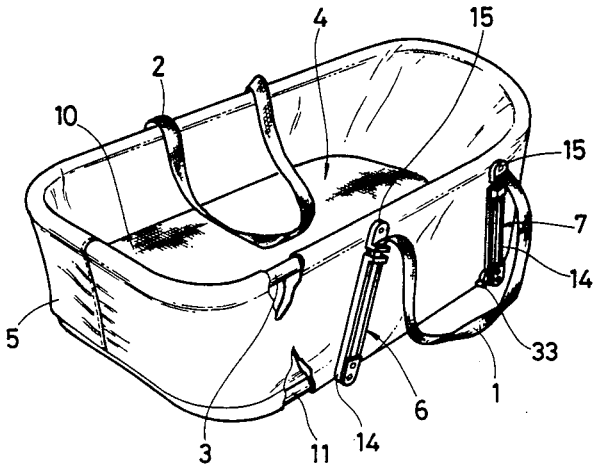
FIG. 1 is a perspective view showing the open state of a carry-cot according to an embodiment of this invention, with the sheet material of the lateral wall shown partly broken away.
Figure 2:
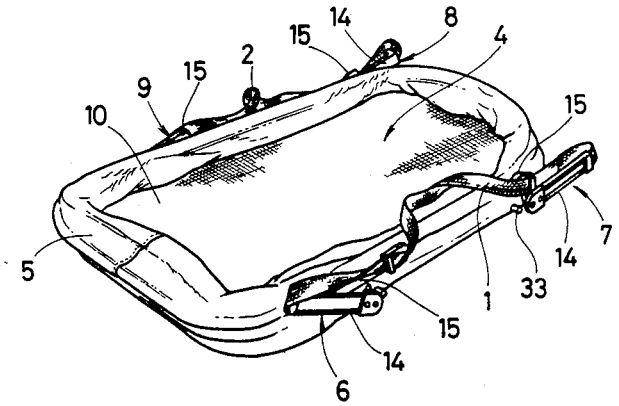
FIG. 2 is a perspective view showing the collapsed state of the carry-cot of FIG. 1.

The illustrated carry-cot assumes the FIG. 1 state when in use, and if desired when it is not used, it can be collapsed as shown in FIG. 2.

The carry-cot is, as a whole, has the form of an upwardly open box with flexible belts 1 and 2 attached at the their opposite ends of the carry-cot at four points positioned around the center of gravity of the carry-cot. Therefore, when in use, the carry-cot is suspended by lifting these belts 1 and 2, so that it can be carried from place to place with a baby placed therein.

The carry-cot comprises, as main components, an upper frame 3 surrounding the upper surface opening, a lower base 4 disposed parallel to and below said upper frame 3 and forming a bottom wall, a flexible sheet material 5 stretched between the upper frame 3 and the peripheral edge of the lower base 4 forms the entire lateral wall including two longitudinal side wall sections, a head wall section and a foot wall section. First and second link means 6, 7 forming a pair, and third and fourth link means 8, 9 forming another pair interconnect the upper frame 3 and the lower base 4 in such a manner that they can move toward and away from each other. The link means 8 and 9 are not shown in FIG. 1 as they are hidden and in FIG. 2 they are only partly shown, but they are respectively of the same construction as the first and second link means 6 and 7. Further, the first and second link means 6 and 7 and the third and fourth link means 7 and 8 are respectively symmetrical in shape relative to each other.

In this embodiment, the lower base 4 includes a bottom plate 10 and a lower frame 11. The sheet material 5 is in the form of a woven or knitted fabric or film made of synthetic resin and is suitably sewn up and fastened to the upper frame 3 and lower frame 11. More particularly, the sheet material 5 is wrapped around the upper frame 3 is doubled between the upper frame 3 and the lower frame 11 and extends to cover the lower surface of the lower frame (see FIG. 6) to form a container which is open only at its top. Therefore, if the sheet material 5 is waterproof, the carry-cot will float on water and could be used as a handy boat to place a baby thereon for amusement at the seashore if the weather is calm.

Figure 3:
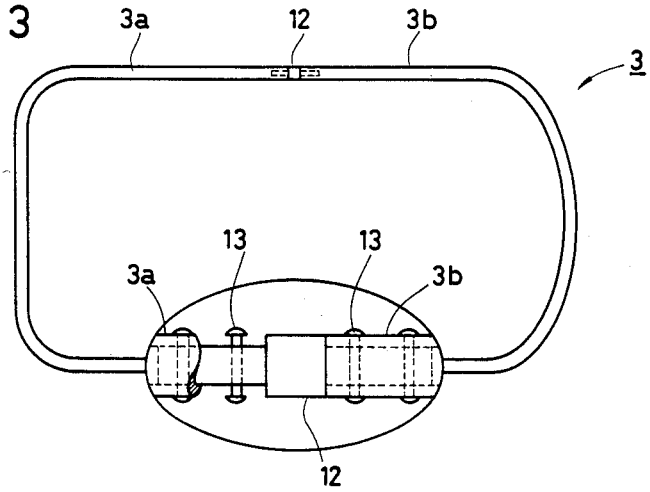
FIG. 3 is a plan view, partly enlarged, of an upper frame included in the carry-cot of FIG. 1.

The upper and lower frames 3 and 11 are fabricated of steel, aluminum or other pipe. The cross-sectional shape of this pipe may be circular, oval, or quadrangular. The upper frame 3 is shown in FIG. 3 in the form of a closed hoop, which may be formed of two halves 3*a* and 3*b* arranged with their ends opposed to each other and connected by a joint 12 into which the ends are inserted and fixed in position by rivets 13. The lower frame 11 is constructed in a similar manner.

The upper and lower frames 3 and 11 are substantially rectangular, with their respective long sides extending parallel to each other. Disposed on the parallel long sides are the aforesaid link means 6 to 9.

FIGS. 4 to 12 show the second link means 7. Since the individual link means 6 to 9 are of the same, symmetrical shape, as described above, the arrangement of the link means will be described below by taking up the second link means 7 as a representative.

The link means 7 comprises a combination of a main support rod 14 and an auxiliary support rod 15, whereby the latter is about half as long as the main support rod 14. The auxiliary support rod 15 is journalled at its lower end to a lengthwise intermediate portion of the main support rod 14 by a journal connecting pin 16 so that when the main and auxiliary support rods 14 and 15 are aligned with each other, they overlap each other.

The main support rod 14 is made of synthetic resin, for example. The main support rod 14, as shown in FIG. 5, is formed with a U-shaped cross-section portion 17, which receives the auxiliary support rod 15 when the rods are aligned with each other. The innermost wall of the U-shaped cross-section portion 17 provides means which permit the folding of the rods 14 and 15 relative to each other only in one collapsing direction A. In the opposite direction the rods 14 and 15 can only be straightened. That is, in FIG. 4 the link means 7 is collapsible only in the direction A in which the connection, i.e., the connecting pin 16, between the main and auxiliary support rods 14 and 15 is moved to the right. The lower end of the main support rod 14 is journalled to the outer peripheral edge of the lower frame 11 by a journal connecting pin 18.

Figure 7:
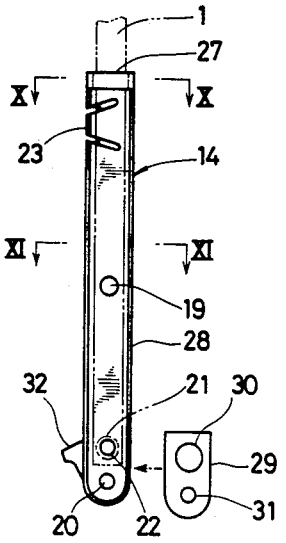
FIG. 7 is a front view of a main support rod included in the link means of FIG. 4, also showing a belt section in phantom lines.
Figure 8:
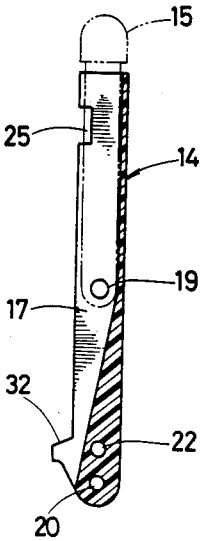
FIG. 8 is a front view, in longitudinal section, of the main support rod of FIG. 7, also showing an auxiliary support rod in dash dotted lines.
Figure 9:
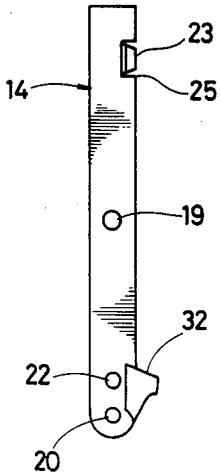
FIG. 9 is a back view of the main support rod of FIG. 7.

The main support rod 14 is shown in full lines in FIGS. 7 to 11. The U-shaped cross-section portion 17 shown in FIG. 10 of the main support rod 14, as shown in FIG. 8, is formed only in a relatively upper portion of the main support rod 14. The main support rod 14 is formed with throughgoing holes 19 and 20 for receiving said connecting pins 19 and 20. A throughgoing hole 22 is provided for receiving a pin 21 for attaching the belt 1. The outer (front) wall of the U-shaped cross-section portion 17 is formed with two cuts obliquely extending in the side walls from one of its narrow edges, the portion between said cuts serving as an engaging piece 23. The cross-sectional shape of the engaging piece 23 is best shown in FIG. 5, and the front end of the engaging piece 23 is formed with a projection 24. Opposite the position where the engaging piece 23 is provided, the inner (back) wall of the U-shaped cross-section portion 17 is formed with a notch 25. This notch 25 serves to facilitate the insertion of the auxiliary rod 15 into the portion 17 of the main rod 14 while also permitting the operation on the projection 24 of the engaging piece 23. If the main support rod 14 is made of resin, the engaging piece 23 will be elastically deformable due to elasticity of the resin for the insertion of the rod 15 into the portion 17 and for also holding the rod 15 in parallel to rod 14.

Figure 10:
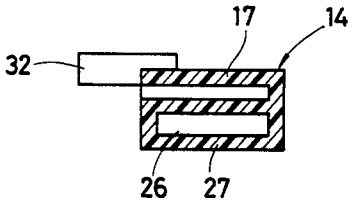
FIG. 10 is an enlarged sectional view taken along the line X—X of FIG. 7.
Figure 11:
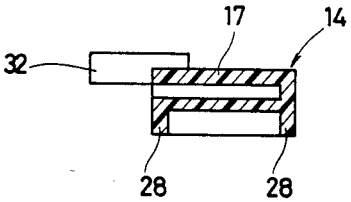
FIG. 11 is an enlarged sectional view taken along the line XI—XI of FIG. 7.

The upper end of the main support rod 14 is provided with a belt guide 27 shown in FIG. 10 formed with a belt receiving hole 26. The belt 1 extends through the belt receiving hole 26 and then along the outer surface of the main support rod 14 and is fixed at its lower end to the main support rod 14 by the aforesaid attaching pin 21. The belt 1 is made by molding a flexible resin or weaving a fiber of flexible resin. Thus, since the belt 1 is easily deformable, it is preferable to form the opposite sides of the outer surface of the main support rod 14 with ribs 28 between the end of the belt 1 and the belt guide 27 for holding the belt 1 therebetween to prevent the belt 1 from slipping off the main support rod 14.

Figure 4:
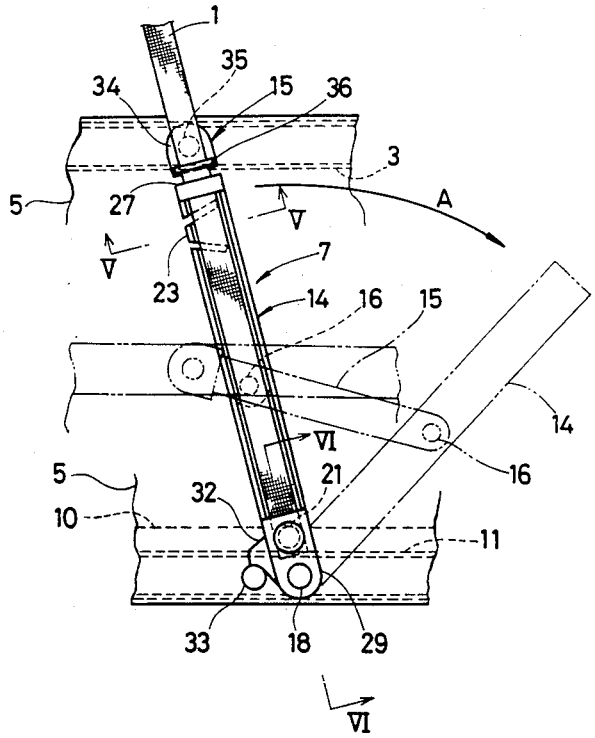
FIG. 4 is an enlarged front view of a portion of FIG. 1 where a link means of the carry-cot is installed.
Figure 5:
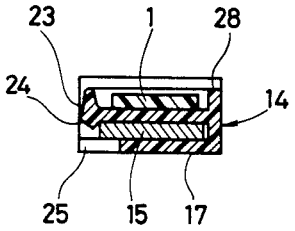
FIG. 5 is an enlarged sectional view taken along the line V—V of FIG. 4.
Figure 6:
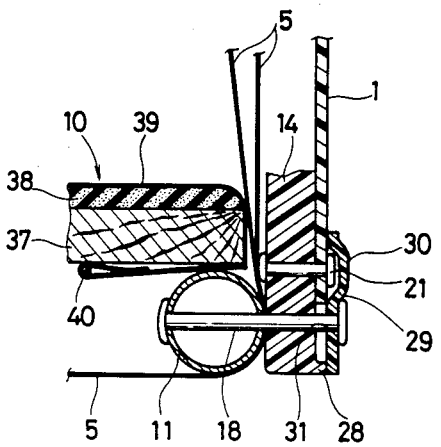
FIG. 6 is an enlarged sectional view taken along the line VI—VI of FIG. 4.

As shown in FIGS. 4, 6, and 7, in the attached state of the main support rod 14, it is preferable to provide a cover 29 for covering the lower end of the main support rod 14. The cover 29 has a bulge 30 for accommodating the head of the attaching pin 21, and a throughgoing hole 31 for receiving the aforesaid journal connecting pin 18. Therefore, the cover 29 is fixed to the main support rod 14 by the connecting pin 18.

The lower end of the main support rod 14 has a lateral extension 32. A projection 33 is provided on the lower frame 11. The extension 32 and projection 33 cooperate with each other as stop means for limiting of the turning movement of the main support rod 14 relative to the lower frame 11 in the cot opening direction opposite to the collapsing direction A. As shown in FIG. 4, when the extension 32 is in contact with the projection 33, the main support rod 14 is prevented from further turning counterclockwise around the axis of the connecting pin 18.

The auxiliary support rod 15 is primarily made of aluminum, for example. The upper end of the auxiliary support rod 15 has a head 34 made of resin, for example, and a connecting pin 35 is passed therethrough to turnably connect it to the upper frame 3 to the rod 15. The positional relation between this connecting pin 35 and the aforesaid connecting pin 18 has an important meaning. That is, the positions of the connecting pins 18 and 35 are so selected that when the link means 6 to 9 respectively assume a linear or straight state, as shown in FIG. 1, the first and second link means 6 and 7 are directed obliquely upwardly with their upper ends positioned closer to each other than their lower ends and so are the third and fourth link means 8 and 9. Thus, it follows that the first and second link means 6 and 7 and the third and fourth link means 8 and 9 are respectively arranged in an inverted V-form when the cot is in the open use state.

Figure 12:
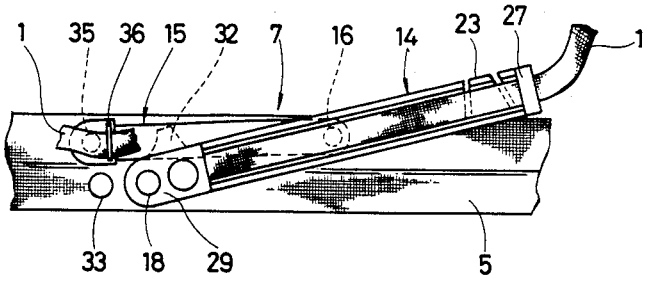
FIG. 12 shows a view similar to that of FIG. 4, but illustrating the collapsed state of the carry-cot other than the operational state.

As shown in FIGS. 4 and 12, it is preferable to provide a belt guide 36 on the upper end of the auxiliary support rod 15. The belt 1 is loosely inserted in the belt guide 36 with some play. The belt guide 36 is preferably made of metal to provide sufficient strength. This belt guide 36 advantageously functions in a manner enabling two persons standing on opposite sides of the carry-cot to convey the carry-cot while each person holds one of the two belts 1 and 2. In this case, since the belts 1 and 2 are forced to move away from the sides of the carry-cot, the belt guides 27 on the main support rods 14 made of resin could be damaged, but the provision of the belt guides 36 made of relatively high strength metal compensates for the strength of relatively weak belt guides 27.

The belt 1, as shown in FIGS. 4 and 12, is passed through the two belt guides 27 and 36. Therefore, portions of the main and auxiliary support rods 14 and 15 are hidden by the belt 1 and hence such parts as the connecting pins 16 and 35 which present a relatively unsightly appearance are hidden, so that a neat appearance can be exhibited.

FIG. 6 shows the cross-sectional construction of the aforesaid bottom plate 10 in the form of a plywood plate 37, for example, with an elastic foam pad 38 placed thereon, the assembly being covered with a fabric 39. The fabric 39 extends around and down to the lower surface of the plywood plate 38 and is kept under tension by a rubber string 40. As is clear from FIG. 6, the bottom plate 10 is simply placed on the lower frame 11 and hence it can be easily removed. This arrangement facilitates the laundering of the fabric 39 on the bottom plate 10.

The method of operating the aforesaid carry-cot will now be described.

In the use state shown in FIG. 1, the auxiliary support rods 15 are received in the U-shaped cross-section portions 17 of the main support rods 14, and the projections 24 on the engaging pieces 23 are engaged with the lateral narrow edges of the auxiliary support rods 15 (FIG. 5). Therefore, the link means 6 to 9 are respectively in the linear state. Further, the extensions 32 formed on the main support rods 14 are in contact with the projections 33, thereby preventing any further turning movement which causes the upper ends of the first and second link means 6 and 7 to move toward each other beyond the desired position. The same applies to the third and fourth link means 8 and 9. Therefore, the upper and lower frames 3 and 11 are maintained substantially parallel to each other and at the maximum distance therebetween. Moreover, the frames 3, 11 are firmly held against horizontal deviation relative to each other. In this state of FIG. 1, the carry-cot can be carried from place to place with a baby in the cot by the user holding the two belts 1 and 2 either by hand or on the shoulder.

When it is desired to collapse the carry-cot, first the engaging piece 23 is outwardly deformed by inserting the thumb through the notch 25 of the main support rod 14. With this state maintained, a force in the direction of arrow A (FIG. 4) is applied to the main support rod 14, whereupon the auxiliary support rod 15 is released from the engagement otherwise caused by the engaging piece 23. After such operation has been performed on all the link means 6 to 9, it is only necessary to apply a force to each main support rod 14 to turn it in the direction of arrow A. This force may be directly applied to the main support rod 14 or exerted by downwardly pressing the upper frame 3. In response thereto, the main and auxiliary support rods 14 and 15 are turned in predetermined directions, with the main frame 3 moving downward, as shown in phantom lines in FIG. 4. Further, this movement proceeds until the link means 7 reaches the fully collapsed state as shown in FIG. 12, with the carry-cot assuming the flat collapsed state shown in FIG. 2.

When it is desired to change the FIG. 2 state back into the FIG. 1 state, this can be attained by lifting the upper frame 3. As a result, the main and auxiliary support rods 14 and 15 are turned in predetermined directions and the use state shown in FIG. 1 is automatically obtained. That is, the auxiliary support rod 15 enters the U-shaped cross-section portion 17 of the main support rod 14 and the extension 32 contacts the projection 33.

In the aforesaid embodiment, when the carry-cot is carried from place to place by means of the belts 1 and 2, the directions taken by the ends of the belts 1 and 2 substantially coincide with the directions taken by the main support rods 14. Therefore, the attitude of the main support rods 14 is stably held also by the belts 1 and 2.

In addition, if the projections 33 shown in FIG. 4 are formed by a long shaft extending across the two opposed long sides of the lower frame 11, this shaft will serve as a reinforcing member for the lower frame and also as auxiliary holding means for the bottom plate 10.

Further, the carry-cot of this invention can also be used by placing it in a baby carriage or on the seat of an automobile.

Although the present invention has been described and illustrated in detail, it is clearly understood that the same is by way of illustration and example only and is not to be taken by way of limitation, the scope of the present invention being limited only by the terms of the appended claims.

What is claimed is:

1. In a box-type carry-cot having a box frame with an open top and flexible belt means (1, 2) having opposed ends connected to frame points located to surround the center of gravity of the carry-cot, so that the carry-cot can be suspended by lifting the belts, the improvement comprising an upper frame (3) forming a peripheral edge defining said open top, a lower base (4) forming a peripheral edge and disposed parallel to and below said upper frame (3) and defining a bottom wall of the carry-cot, flexible sheet means (5) stretched between said upper frame (3) and the peripheral edge of said lower base (4) for forming box side walls, a head wall and a foot wall, first, second, third and fourth link means (6, 7, 8, 9) arranged in pairs for holding said upper frame (3) and said lower base (4) so as to allow them to move toward and away from each other, each link means comprising a main support rod (14) having upper and lower ends, and an auxiliary support rod (15) also having upper and lower ends first journal means (16) for connecting said lower end of said auxiliary support rod to a lengthwise intermediate portion of said main support rod (14) so that said rods can overlap each other when the rods extend longitudinally in parallel with each other, said first and second link means (6, 7) being disposed on one side of said cot and said third and fourth link means (8, 9) being disposed on the other side of the said cot, second journal means (18) for connecting said lower ends of said individual main support rods to an outer periphery of said lower base (4) at four points surrounding the center of gravity of the carry-cot, third journal means (35) for individually connecting said upper ends of said auxiliary support rods (15) to an outer peripheral edge of said upper frame (3) so that when said individual link means (6 to 9) are respectively in the linear state, the first and second link means (6, 7) on the one hand and the third and fourth link means on the other hand are directed obliquely upwardly with their upper ends positioned closer to each other than their respective lower ends, first folding stop means (17) enabling said first and second link means (6, 7) and said third and fourth link means (8, 9) to collapse from their respective linear states only in one direction (A) in which said upper ends of said main and auxiliary support rods (14, 15) move away from each other, second folding stop means (32, 33) for limiting the cot opening movement of said individual link means when they are respectively in the linear state and for maintaining said upper frame (3) and said lower base (4) at a maximum distance from each other and substantially parallel to each other, whereby said main support rods (14) of each pair are prevented from further rotating in the direction in which they approach each other, locking means (23) for elastically engaging said main and auxiliary support rods (14, 15) of a pair with each other to maintain the main and auxiliary rods in the linear state, wherein said belt means include a first belt (1) attached with its ends to the lower ends of said main support rods of said first and second link means (6, 7) and a second belt (2) attached with its ends to the lower ends of said main support rods of said third and fourth link means (8, 9), and wherein each of said main support rods (14) comprises belt guide means (27) defining a belt receiving hole (26) substantially at the upper end of the respective main support rod, said first and second belts (1, 2) being inserted in the respective belt receiving hole for maintaining the respective belt end substantially alongside the respective main support rod.

2. The carry-cot as set forth in claim 1, wherein said lower base (4) comprises a lower frame (11) and a rigid bottom plate (10) placed on said lower frame (11), and wherein said main support rods (124) are attached at their lower ends to said lower frame (11).

3. The carry-cot as set forth in claim 2, wherein said flexible sheet means (5) covers said lower frame (11) and further extends from one lower frame side to the other to form a container open only at the top.

4. The carry-cot as set forth in claim 1, wherein said upper frame (3) and said lower base (4) have outer peripheral edges extending, at least in part, parallel to each other, and said link means are positioned on said parallelly extending outer peripheral edges.

5. The carry-cot as set forth in claim 1, wherein said first folding stop means comprises a U-shaped cross-section portion (17) on each of said main support rods (14), and wherein said auxiliary support rods (15) are received in said U-shaped cross-section portions (17), whereby the collapsing movement of said link means is limited.

6. The carry-cot as set forth in claim 1, wherein said second folding stop means comprises an extension (32) extending laterally from the lower end of each main support rod (14), and a projection (33) projecting from said lower base in a position enabling it to contact said extension (33) when said cot is in its unfolded use state.

7. The carry-cot as set forth in claim 1, wherein said locking means comprises an elastically deformably engaging piece (23) formed adjacent the upper end of said main support rod (14) and adapted to engage said auxiliary support rod (15) for holding said main support rod and its respective auxiliary support rod in the straight position in parallel to each other.

8. The carry-cot as set forth in claim 7, wherein each main support rod (14) is made of a sufficiently flexible material, and each of said engaging pieces (23) is formed as a portion between two cuts in the main support rod (14).

9. The carry-cot as set forth in claim 1, wherein the upper end of each said auxiliary support rod (15) comprises a second belt guide (36), and wherein said belts (1, 2) are inserted in said second belt guides with a certain play permitting the belts to move in said second belt guides.

* * * * *